United States Patent [19]

Vogel

[11] 4,161,926

[45] Jul. 24, 1979

[54] ENGINE PARAMETER MODULATION

[76] Inventor: Uriel Vogel, P.O. Box 408, Huntington, N.Y. 11743

[21] Appl. No.: 785,103

[22] Filed: Apr. 6, 1977

[51] Int. Cl.[2] ..... F02B 33/00; F02M 7/12

[52] U.S. Cl. ..... 123/32 EA; 123/119 EC

[58] Field of Search .... 123/119 EC, 119 R, 139 AW, 123/32 ED, 32 EA; 60/285; 417/137; 261/72 R, DIG. 67

[56] References Cited

U.S. PATENT DOCUMENTS

| | | | |
|---|---|---|---|
| 3,123,015 | 3/1964 | Linklater | 417/137 |
| 3,768,259 | 10/1973 | Carnahan et al. | 60/285 |
| 3,921,612 | 11/1975 | Aono | 123/119 R |
| 3,945,350 | 3/1976 | Ford | 123/119 R |
| 3,949,551 | 4/1976 | Eichter et al. | 60/285 |
| 4,027,637 | 6/1977 | Aono | 123/119 EC |
| 4,046,118 | 9/1977 | Aono | 123/119 EC |

OTHER PUBLICATIONS

Schweitzer et al., "Electronic Optimizer Control for I.C. Engine," Feb. 1975, SAE Publ. No. SP-393, pp. 155-181.

*Primary Examiner*—Carlton R. Croyle
*Assistant Examiner*—Thomas I. Ross

[57] ABSTRACT

Method and apparatus for modulating engine parameter actuators at speeds and variety of waveforms suited for the detection and elimination of engine performance degradation due to perturbations caused by environmental changes as well as by wear in use, structural and other design limitations. An actuator is made responsive to gas pressure which is modulated by forcing gas flow through a chamber connected to the actuator. The flow enters the chamber through a variable orifice comprising a solid block with bores facing corresponding bores in a drum rotating at a speed synchronized to the engine speed. The modulation of pressure delivered, as a result, to the actuator may be controlled, by computer or manually, by controlling the relative phase between the drum and engine rotations and the pressure of gas supplying the flow through the variable orifice and the chamber.

14 Claims, 3 Drawing Figures

FIG. 2
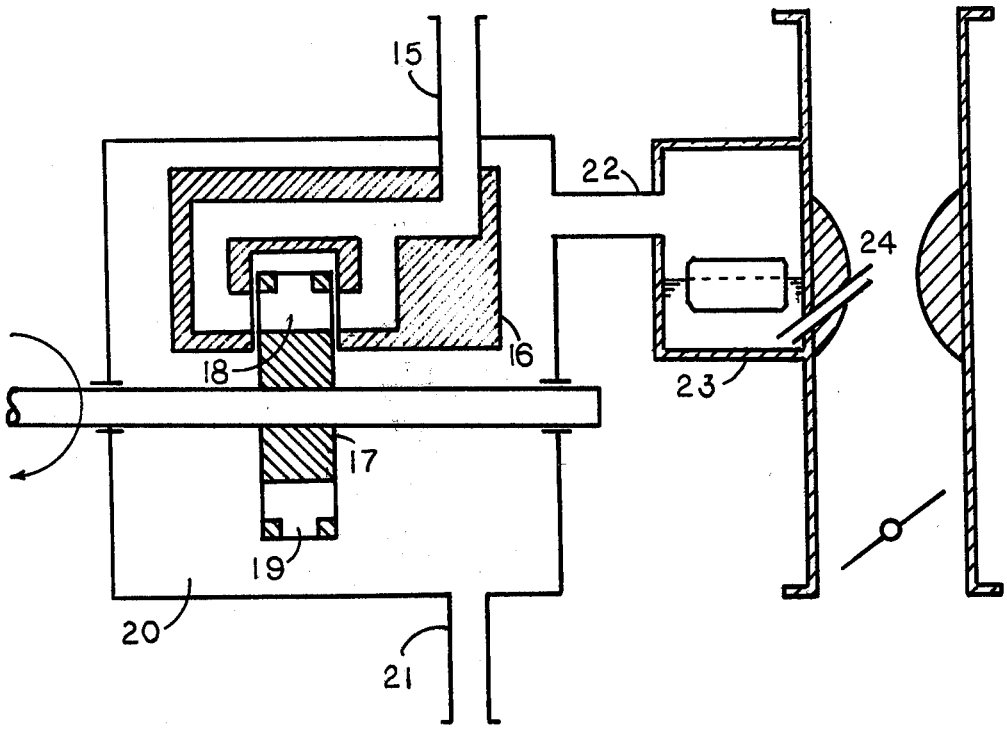
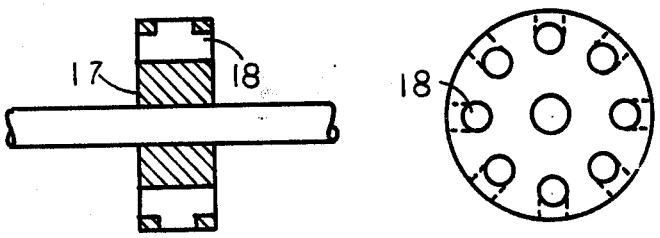
FIG. 2A

ENGINE PARAMETER MODULATION

BACKGROUND OF THE INVENTION

1. Field of the Invention

This invention relates to engine tuning systems where parameters controlling the engine efficiency of operation are modulated so that signals are derived that represent corresponding deviations from an optimum point of operation and said signals are used to control said parameters so that the engine is maintained at a desired optimum point of operation.

2. Description of the Prior Art

Systems that control and tune engines, and in particular internal combustion engines, have been operated and described in the literature. In the Society of Automotive Engineers (SAE) publication No. SP-393 (IEEE Catalog Number 75H0976-1VT), for example, dated February 1975 several engine control systems are described that are designed to improve the performance and fuel economy of internal combustion engines.

Certain control components are always included in the above systems that serve the function of modulating at least one of several parameters that affect engine performance. Modulation, or in other words variation of said parameters, is required at least for the compensation of environmental changes that cause shifts from the optimum operating point of the engine. In optimizing control systems such as described on pages 155 to 182 of said SAE publication No. SP-393 the modulation or dithering of said parameters is also required for the sensing of shifts in the operating point of the engine. A study of control systems in general and the above mentioned references in particular confirms the fact that the effectiveness of control and speed of response to control commands depends directly on the speed with which said control parameters can be changed or modulated. This speed presents a basic limitation on the effectiveness of said control systems and is caused essentially by inertia or stored energies involved whenever force has to be exerted inorder to cause movement of any actuator modulating a control parameter. In fuel injected engines, for example, a considerable force is needed to cause liquid fuel to flow through small orifices into the engine intake duct and within very short periods of time. This requires a considerable amount of energy which results in injectors with a certain size or bulk. Delays are thus created between the instant a command to inject is received and the time that fuel is actually being injected into the engine intake duct. This basic limitation becomes more serious the higher the engine RPM's and calls for special injector designs even for regular fuel injection systems. This limitation becomes more severe when closed loop control is considered for fuel injected engines such as described in said SAE publication No. SP-393 (pages 137 to 144) for example. Faster, more efficient and responsive injectors are therefore needed inorder to improve the performance and efficiency of engine operation. It is therefore an object of this invention to provide faster, more powerful and more responsive injectors than presently available. It is yet a further object of this invention to provide actuating means for fast and responsive actuators controlling engine parameters.

A special type of parameter control is involved in engine optimizing systems such as described in said SAE publication (pages 155 to 182)—the so called dithering control. Dithering is required to provide sufficiently high modulation speeds and also waveforms that are not necessarily pulsed as in the case of fuel injection but belong to a wider class of waveforms. An example of a dither control can be seen in FIG. 13 on page 166 of said SAE publication. As shown, the speed of control may be sufficient for the purpose intended but the fuel to air ratio dither waveshape is there limited in both waveform and intensity. This limitation appears more severe when it is realized that the pressure in the intake duct of an internal combustion engine is strongly modulated by the periodic movements of the pistons and valves. It can now be recognized that the fuel to air ratio of the mixture flowing into the engine cylinders is a complex function of time indeed. It is therefore obvious that the dithering speed cannot be increased without a corresponding increase in the presence of extraneous modulation superimposed on the intended dithering signal waveform. An added complication is the nonlinearity involved in the above dither which makes the associated system control circuits and in particular the engine efficiency or speed detection and processing circuits more complex and costly. It is therefore another object of this invention to provide increased modulation capabilities with regard to waveform and intensity and make this modulation largely independent of extraneous effects.

The expanding application of computers in general and in engine control in particular has introduced a very powerful and economical means for fast and complex processing of signals. Actuators for engine control parameters, on the other hand, are at present too slow in response and limited in their ability to produce a wide class of signals that is within the capability of computers to handle. This has created a need for faster and more responsive actuators. This need is, of course, not caused by the mere availability of computer processing power but rather by the great benefits to be derived from faster and more responsive actuators. To see this it is sufficient to consider the increase in engine efficiency or fuel economy that would result from faster tracking and more complete cancellation of engine perturbations caused by environmental changes. Considering, further, system diagrams, such as those shown in FIGS. 12 and 13 of said SAE publication on pages 165 and 166 for example, it can be seen that several system components must be improved inorder to improve the overall performance of the control system. It is thus necessary to increase the speed and responsiveness of the DITHER as well as those of the CELSIG and the SERVO inorder to get the full benefit from the increased speed of processing by the LOGIC circuits afforded by the computer. In fact, logic circuits, as is well known, can always be considered part of a computer and the increase in speed and capabilities of the computer means also corresponding increases in the logic. The computer can, however, do more than just improve the performance of logic; it can be used to replace many slow acting and bulky components of the control system. Virtually all hardware functions except the SERVO and DITHER output actuators can be replaced by computer software. The CELSIG unit, for example, which senses the engine acceleration is, in most embodiments, an electromechanical device. This entire unit may be replaced by measuring the frequency of the alternator (above SAE reference) and by feeding the measured values as input to the computer. The acceleration can then be derived by numerical processing as directed by the computer program and at processing speeds and accuracies that are far greater than those achievable by electromechanical SELSIG's. It may be noted at this point that the capabilities and techniques of computer system control are well known and appreciated and, by themselves, not essential for the understanding of this invention. Their discussion is nevertheless helpful in pointing out the problems that the present invention intends to solve. Considering further the above example of a CELSIG, the employment of the engine alternator as a source of speed information entails several limitations one of which involves electrical noise produced by mechanical vibrations. Clearly, an operating engine environment is a ready and constant source of such vibrations. The effect of the alternator is then made even more complex by the flexible belt that is usually employed to drive the alternator. The result is that acceleration values derived from the alternator output have noise superimposed on them so that the accuracy or resolution of the CELSIG is limited and this reduces the effectiveness of the optimizing system. It is therefore another object of this invention to provide an apparatus and a method for decoupling the actuator (the DITHER for example) from the mechanical and electrical environment of the engine and render the actuator modulation essentially independent of extraneous effects. Among the benefits to be derived from the increase in speed of response of control systems is the fact that perturbations of ever faster variations can be tracked more closely resulting in more complete cancellation of their adverse effects. This can be demonstrated by the example of an engine control system equipped with responsive actuators according to this invention and controlled preferably by a computer. The combustible mixture flowing into the engine cylinders has a waveform or modulation which is a complex function of time with frequency components corresponding to the speed of the engine. The engine frequency of revolution, for example, is one of the components but many more, including those of higher frequencies, are present in the mixture waveform. When the response speed of the engine control system is increased towards the range of the above modulation frequencies, and beyond, the stage is reached where the performance of the control system would start to degrade. This degradation can be avoided if the speed of response of the engine efficiency or speed or torque sensing elements of the control system is also increased. Considering, more particularly, an engine with a plurality of cylinders it can be appreciated that the combustible mixture modulation is likely to be different for each of the individual cylinders. If the control system does not take these differences into account and processes just average efficiency variations a significant improvement in performance may thereby be lost. If, on the other hand, signals generated by the engine speed sensor (for example) are processed so that accelerations due to individual cylinder power strokes are derived optimization of individual cylinder operation can be achieved. The engine acceleration due to individual power strokes can, for example, be derived by measuring the length of time between adjacent strokes of different cylinders. This time is shorter the higher the mechanical energy derived from a particular stroke and for a given resistance or engine load torque. Successive measurements of said lengths of time for the same ("dithered") cylinder provide a means for assessing the relative efficiencies of said cylinder power strokes. It is therefore another object of this invention to provide a new method and apparatus for actuating or dithering of individual parameters affecting engine efficiency. The resulting optimization and equalization of efficiencies between individual cylinders would reduce engine vibrations.

Vibrations in mechanical systems such as an engine with a large number of linkages, gears, bearings and the like are a source of dissipative energy losses, i.e. reduced efficiency, as well as a source for extra wear and surfaces deterioration. The increase in the above efficiency as well as the reduction of deterioration and wear are therefore other objects of this invention.

SUMMARY OF THE INVENTION

This invention accomplishes the purpose of affecting fast variations in engine parameters by modulating pressure of gas supplied to said actuators. This provides the levels of energy that are usually needed to move the actuators at the speeds contemplated by this invention. The above modulation of gas pressure is accomplished by gas flowing through variable orifices into a chamber and out of it into a vacum source or some other gas sink. The variation of said variable orifices is carried out by varying their effective cross-sectional areas thereby causing variations in the rate of gasflow and therefore also in the gas pressure in said chamber. In the preferred embodiment, described hereinafter, the variable orifice areas are achieved by letting said gas to flow through bores in a solid block and a rotating drum. The bores form orifices at corresponding surfaces with small gaps between said solid block and said drum and are made to fit face to face at certain angular positions of the drum. As the drum rotates the effective area of the orifice is changed when the corresponding orifices in the block and the drum move towards or away from each other. The rate of said gas flow is therefore constantly changing in synchronism with said drum rotation resulting in corresponding pressure changes in said chamber. These changes or pressure modulation can be made very fast and cover a wide class of pressure waveforms and satisfies the objects of this invention. The speed of response is one of these objects but the above method satisfies also the object of providing sufficient energy to move said engine parameter actuators since this energy resides in the gas flowing through said chamber and is only controlled by fast acting valves, i.e. by said variable orifices.

The method of this invention also provides great flexibility, which is another object of this invention, in covering a wide class of control pressure waveforms by the flexibility inherent in said orifices cross-sectional shapes and sizes and in the combined effect of employing a plurality of said drums enclosed in said chamber and rotated at different and variable relative phases. An extremely wide range of pressure variations and waveforms can thus be realized.

The speed of said control pressure modulation is a function of the speed of rotation of said drum which is synchronized to the engine speed but is essentially independent of extraneous effects. These effects which include both electrical noise and mechanical vibrations are isolated or decoupled from the motion of said drum by a synchronous motor means driving the drum. The flexibility inherent in this feature of the present invention can be seen by considering the inertia of said rotating drum in some embodiments and the wide options available in other embodiments, to those skilled in the art, in the filtering out, for example, of said extraneous effects by electronic means associated with said synchronous motor means. A simple example for the above decoupling of motion is when said synchronous motor means with said drum and chamber are not mounted on the engine but rather on a mechanically decoupled platform and said modulated chamber pressure is fed to said engine parameter actuator through a flexible pipe. Electronically, the above decoupling may be achieved by making the synchronizing signals driving said synchronous motor substantially independent of irregularities in the engine's rotation. An electronic method of decoupling may comprise a phase locked loop oscillator synchronized to the engine rotation. Said oscillator frequency would follow slow changes in engine speed but will ignore fast, irregular, changes in speed. Said synchronous motor rotation could then be synchronized to said phase locked loop oscillator frequency with the result that fast, irregular, changes in engine speed will be eliminated from the motion of said synchronous motor.

The above and further novel features and objects of this invention will appear more fully from the following description and claims when read in connection with the accompanying drawings.

BRIEF DESCRIPTION OF THE DRAWINGS

FIG. 2 is a sectional view of the preferred embodiment of a pressure modulator and engine parameter actuator according to the present invention.

FIG. 2A shows two views of an orifice drum according to the present invention.

DESCRIPTION OF THE PREFERRED EMBODIMENTS

Figure 1:
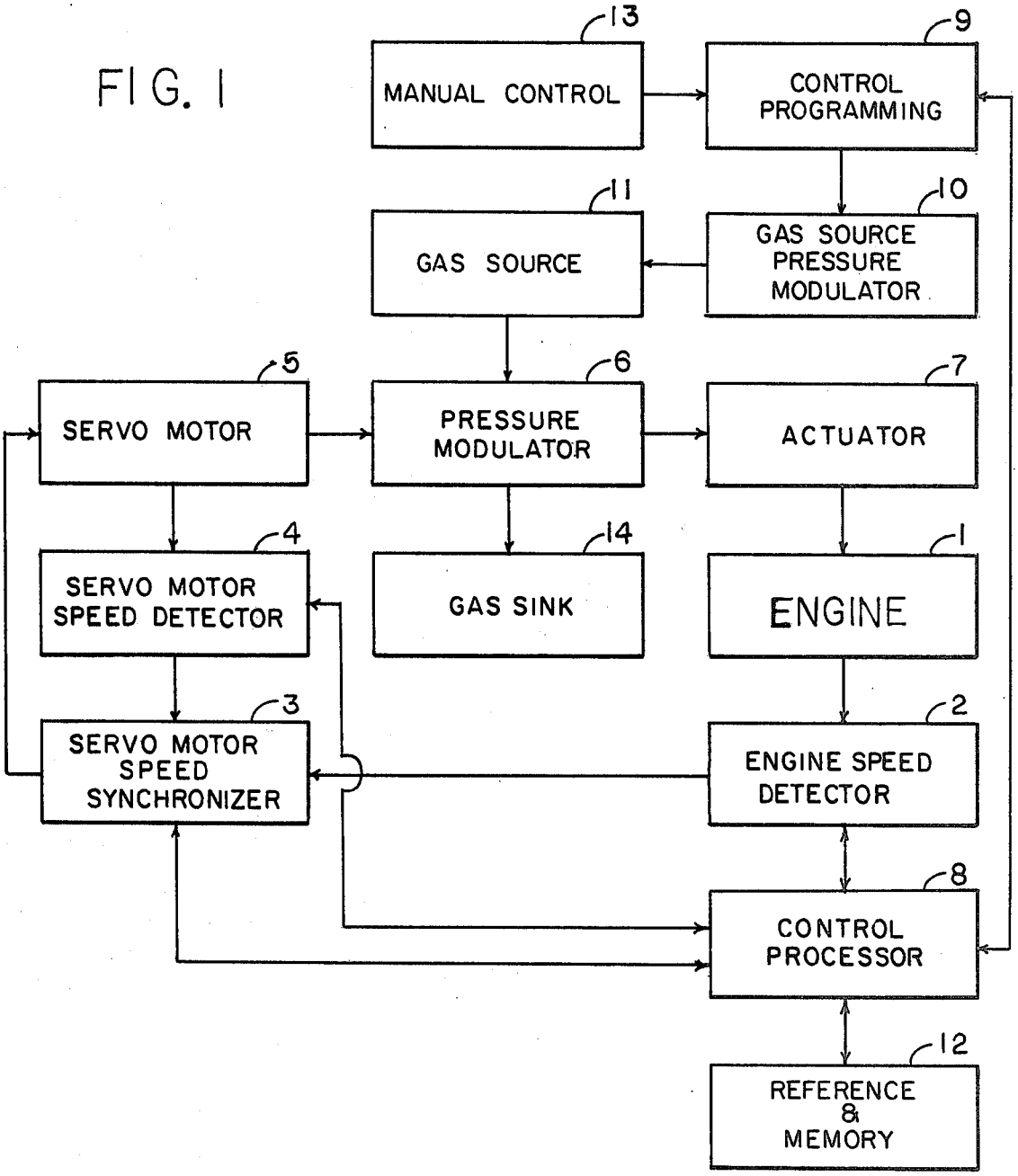
FIG. 1 is a partial schematic diagram of an engine control system comprising the present invention.

Referring to FIG. 1, the engine efficiency of operation is determined by gas (air) pressure in the fuel bowl of the carburetor. Modulation of this pressure modulates the Fuel to Air Ratio supplied to the engine. The system has two main control loops. Loop A comprises units: 1,2,3,4,5,6,7 and Loop B comprises units: 1,2,8,9,10,11,6,7. The purpose of Loop A is to modulate the engine efficiency in such a way that the engine's deviation from the point of optimum operation can be measured from the output signals of unit 2. This is carried out by unit 8. Loop A operates by letting signals from units 2 and 4, which detect the engine speed and the Servo Motor speed respectively, enter the Servo Motor Speed Synchronizer 3. Unit 3 compares the two speeds and controls the driving power to the Servo Motor 5 so that the Servo Motor speed tracks the engine speed with negligible error. This is ensured by a minor loop comprising the units 3,4,5 with the engine speed as reference signal. This, consequently, locks the servo motor and the engine at a fixed but controllable relative phase. The Servo Motor therefore drives the Pressure Modulator 6 in synchronism with the engine. This results in modulation of the amount of fuel supplied to the engine per unit time or per intake stroke of a particular cylinder. The modulation of the fuel supply to each of the engine's cylinders may be of a different parameter and or of different strength. In one cylinder for example the modulation may be of the timing of the fuel supply. In another cylinder it may be merely of fuel amount of charge or pulse per stroke. In yet another cylinder it may be a modulation of the fuel pulse shape. The above modulations may in a particular case consist of alternate changes of fuel charge strength for a particular cylinder. An explanation of how this is accomplished by the pressure modulator 6 is given in the description of FIG. 2. The engine with modulated fuel supply undergoes in a particular embodiment small variations in speed. These variations are detected by the Control Processor 8. The processor determines the difference between the efficiency of alternate power strokes. This is a measure of the relative position of the engine's operating point with respect to an optimum point. The processor further determines the amount and direction of the correction signal required to move the engine towards the desired optimum operating point as prescribed by unit 12 (Reference & Memory). The correction signal is fed to unit 9 (Control Programming Unit) where, depending on signals from unit 13 (Manual Control), a driving signal is fed to unit 10 (Gas Source Pressure Modulator). This unit provides variable power required to maintain the needed level of pressure in unit 11 (Gas Source). In a particular embodiment unit 11 is an electrically driven air pump. The output of unit 11 is supplied to the proper input of unit 6 mentioned above. In FIG. 1 unit 6 is shown to feed also into unit 14 (Gas Sink) which in some embodiments may contain a vacum pump and in others feeds into the vacuum system of the engine. Unit 14 is shown in FIG. 1 with only one input. In some embodiments it may replace the function of unit 11 in receiving the control power from unit 10. Unit 6 will then be controlled by the level of vacum from unit 14 rather than by the level of pressure from unit 11. The Manual Control 13 provides the controls necessary to manually select the mode of operation of the system. One mode may provide completely automatic operation where the control Processor 8 forces the engine to track an optimum point of operation as it undergoes environmental changes. Such changes may involve temperature variations for example. Another example is the position of the accelerator pedal in a car. Another mode of operation may set the Control Programming unit 9 to allow purly manual control of the engine's operating point. The operator is then able to manually adjust and bias the engine to any desired operating point.

Referring to FIG. 2, gas (air) at controlled pressure is supplied through pipe 15 to Orifice Block 16. In FIG. 2 this block is shown with two orifices facing each other and feeding a Drum 17 with holes 18. The Drum 17 is rotating at a speed synchronized to the engine speed as explained in the description of FIG. 1. The gas flowing from the Block 16 crosses a gap small enough to minimize loss of pressure. When the rotating Drum 17 brings one of its holes (18) face to face with the orifices of 16 the gas from 15 flows through this hole and its outlet 19 into the pressure modulator chamber 20. The flow then continues to the Gas Sink 14 through pipe 21. The instantaneous pressure in the chamber 20 is determined by the gas pressures at pipes 15 and 21 and by the size of the particular hole 18 in Drum 17 facing the orifices of block 16. The pressure in 20 is also dependent on the position of the Drum 17 or its phase with respect to the Orifice Block 16. The pressure in chamber 20 will then undergo a pulsed modulation. The shape and the strength of the pressure pulses is determined by the shape and size of the holes in the Drum 17. In the case of a 4 cylinder engine for example the shape or size of diametrically opposed holes in the Drum 17 is made different by a small, known, amount. This difference may be purely in phase or angular position. The difference between another pair of holes may be purely in hole diameter. The holes need not be circular and may have any advantageous shape with corresponding variations between diametrically opposed holes. The speed of the Drum 17 is synchronized to the engine so that it is, in the case of 4 cylinders and 8 holes in the drum, ½ the engine distributor speed. This results in alternate modulation of the pressure pulses synchronized to the engine rotation. This modulation need not be alternate and any other suitable scheme may be employed. Continuing with the above case of alternate modulation, the phase of the Servo Motor 5 (FIG. 1) is adjusted with respect to the engine angle of rotation. The pressure pulse peaks in chamber 20 are thus made to occur roughly during the intake stroke of an engine cylinder. Chamber 20 is connected through pipe 22 in the present embodiment to the carburetor fuel bowl 23. The above pressure pulses, synchronized to the engine's rotation, are now modulating the fuel supply to the carburetor venturi 24. Each engine cylinder is modulated differently depending on the particular holes 18 synchronized with its intake stroke. The phase of this modulation is controlled by the Control Processor 8 through the Servo Motor Speed Synchronizer 3. Depending on a particular setting of the Control Programming Unit 9 the processor can switch the holes among the cylinders according to a particular sequence either automatically or manually. In this way any given cylinder may be "dithered" by a different type of variation: in phase, in size or by different types of shape variations, for example. In the same way the "dithering" of other cylinders would also be switched around and complete information on deviations from optimum engine operation would become available.

Any engine parameter can be controlled by this invention provided the actuator is made responsive to gas pressure. Ignition timing is particularly suitable for control by this invention since it is normal practice to control ignition timing by vacuum, i.e., by gas pressure.

In review, the above describes an invention with simple, basic, embodiments that can be synthesized into complex control systems governed by computers. The range of useful applications of this invention is therefore very wide and presents a particular answer to the great need for input/output elements that can, more fully, realize the potential ingerent in computer applications—a generally recognized problem.

The improvements in engine performance, as contemplated by this invention, were already discussed hereinbefore but two aspects merit further comments, now that a better view has been gained from reading this specification.

Perturbations adversely affecting engine performance originate in virtually an infinite number of sources and can, therefore, be represented by an infinitely large class of waveform functions. To fully compensate for and cancel the effects of said adverse perturbations the engine control actuators have also to be represented by an infinitely large class of functions. Such functions are characterized, theoretically, by infinitely fast variations and may be represented by a set of delta functions spread over time. In physical systems, however, waveform functions are band limited and cannot possess infinitely fast variations. The set of delta functions can therefore be replaced by narrow pulse waveforms spread over time (or phase). At this point it becomes apparent that the pressure modulator of the preferred embodiment of this specification provides the basis for the above functions in the form of sharp pressure pulses. There is no need here to further pursue this theoretical confirmation of the present method and apparatus since those skilled in the art will have already appreciated it before. It is however helpful in forming a better understanding of the extent and scope of this invention as well as the basic simplicity of its elements.

The noise reduction and decoupling properties of pressure modulators according to this invention have already been discussed in this specification and must be obvious in the case of periodic modulations and orifice drums, with inertia, rotating at constant speeds. When variable speeds and transient modulations are considered inertia becomes a limitation. However, according to the preferred embodiment of this specification noise decoupling may be accomplished by electronic means rather than by inertia and transient response speed raised by feedback in the synchronous motor means circuits and with low mechanical inertia (hollow orifice drums made of low density materials for example). This is yet another aspect of the beneficial flexibility inherent in this invention.

While specific embodiments and advantages have been discussed in the foregoing various modifications will appear or suggest themselves to those skilled in the art.

I claim:

1. Method for creating an engine parameter control signal to obtain an optimum operating point of said engine, comprising:

creating a supply of pressurized gas flow, directing said gas flow to and through a chamber, modulating the gas flow through the chamber at a certain speed by means whereby pressure of said gas in said chamber is correspondingly modulated, leading said modulated gas pressure to a means responsive to gas pressure whereby an engine parameter is modified, measuring modulation of an output of said engine due to modulation of said parameter whereby the measured modulation of said output is a measure of deviation of an operating point of said engine from an optimum operation point, generating a control signal from said measure of deviation from said optimum operating point, controlling said supply of pressurized gas flow to said chamber according to said control signal, whereby the pressure of said supply is changed, detecting the speed of said engine and synchronizing the speed of said modulation of gas flow with said engine speed whereby any point of said modulation corresponds to a fixed phase of rotation of the engine regardless of speed of said engine, and isolating the modulation means from vibration and noise of said engine, whereby the operating point of said engine is shifted towards said optimum operating point.

2. The invention of claim 1 wherein the modulation of said gas flow is accomplished by modulating the effective area of an orifice limiting said gas flow through said chamber.

3. The invention of claim 1 wherein said modulation speed is accomplished with a synchronous motor means.

4. The invention of claim 3 wherein the modulation of said gas flow is accomplished by modulating the effective area of an orifice limiting said gas flow through said chamber.

5. Apparatus for creating an engine parameter control signal to obtain an optimum operating point of an engine, comprising:

synchronous motor means synchronized to the speed of said engine, means producing a supply of pressurized gas flow, gas pressure modulating means driven from said synchronous motor whereby any point of said gas pressure modulation corresponds to a fixed phase of rotation of said engine regardless of speed of said engine, a chamber in which the modulation means is located, means directing the supply of pressurized gas to the chamber, a gas sink port leading from said chamber, actuating means in fluid connection with said chamber and responsive to pressure in said chamber to modify a parameter of said engine, engine output measuring means for obtaining a measure of deviation of an operating point of said engine from an optimum operating point, means generating a control signal from said measure of deviation from said optimum operating point, means controlling said means producing said supply of pressurized gas glow in response to said control signal, whereby the pressure of said supply is changed, and said synchronous motor means having synchronizing means whereby the motor does not respond to irregular variations in the speed of the engine.

6. The invention of claim 5 wherein said gas flow rate is modulated by a drum means with a plurality of orifices facing corresponding orifices in an orifice block means with small gaps between said drum and said block, said drum and orifice block means are enclosed in said chamber and moved with respect to each other by said synchronous motor means and said gas flow through said chamber is fed to said block means from said gas source means and fed to said gas sink means from said chamber.

7. The invention of claim 6 wherein said modulation of gas flow is accomplished by variations in shapes, sizes and relative spacings of said orifices.

8. The invention of claim 7 wherein changing of gas flow through said chamber is accomplished by means controlling the phase of rotation of said synchronizing means in response to said control signal.

9. The invention of claim 7 wherein a plurality of said gas pressure modulating means controls a plurality of said actuating means.

10. The invention of claim 9 wherein each cylinder of said engine is controlled by a different parameter actuating means.

11. The invention of claim 9 wherein a cylinder of said engine is controlled by a plurality of said gas pressure modulating means.

12. The invention of claim 10 wherein said parameter actuator comprises a carburetor with vent pipes, a fuel bowl of said carburetor effectively plugged and said fuel bowl is connected to said chamber thereby making the pressure at the surface of the fluid in said fuel bowl correspond to gas pressure in said chamber.

13. Apparatus for injecting fuel into the intake duct of an engine equipped with a carburetor wherein vent pipes of a fuel bowl of said carburetor are effectively plugged, comprising:

synchronous motor means synchronized to the speed of the engine, means producing a supply of pressurized gas flow, gas pressure modulating means driven from said synchronous motor whereby any point of said gas pressure modulation corresponds to a fixed phase of rotation of the engine regardless of speed of the engine, a chamber in which the modulating means is located, means directing the supply of pressurized gas to the chamber, through the chamber, and into the chamber, a gas sink port leading from said chamber, pipe means for connecting said chamber to the fuel bowl of said carburetor thereby making the pressure at the surface of the fluid in said fuel bowl correspond said gas pressure in said chamber, speed measuring means for determining the speed of said engine and generating a signal representing the speed of said engine, means for sending the speed signal to a first means for converting said speed of said engine to a synchronizing signal to control said synchronous motor, to a second means generating a pressure control signal from said speed signal, and to a third means generating a phase control signal from said speed signal, means controlling said means producing said supply of pressurized gas flow in response to said pressure control signal, whereby the pressure of said supply is changed, and said synchronous motor means having synchronizing means enabling fixing a new phase of rotation between the engine motion and said modulation of said gas pressure in said chamber in response to said phase control signal.

14. The invention of claim 13 wherein said gas pressure modulating means comprises a drum means with a plurality of orifices facing corresponding orifices in an orifice block means with small gaps between said drum and said block, said drum and orifice block means are enclosed in said chamber and move with respect to each other by said synchronous motor means and said gas flow through said chamber is fed to said drum from a gas source and fed to a gas sink from said chamber.

* * * * *